US009566595B2

(12) United States Patent
Tepas et al.

(10) Patent No.: US 9,566,595 B2
(45) Date of Patent: Feb. 14, 2017

(54) FOAM-FORMING ASSEMBLY AND SQUEEZE FOAMER

(71) Applicant: REXAM AIRSPRAY N.V., Alkmaar (NL)

(72) Inventors: Marcus Cornelis Jacobus Tepas, Callantsoog (NL); Shivan Ramdhiansing, Zoetermeer (NL); Arjen Haisma, Amsterdam (NL); Kim Deiman, Beverwijk (NL); Peter Jozef Jan Albertz, Haarlem (NL)

(73) Assignee: REXAM AIRSPRAY N.V., Alkmaar (NL)

( * ) Notice: Subject to any disclaimer, the term of this patent is extended or adjusted under 35 U.S.C. 154(b) by 194 days.

(21) Appl. No.: 14/250,445

(22) Filed: Apr. 11, 2014

(65) Prior Publication Data

US 2014/0217624 A1 Aug. 7, 2014

Related U.S. Application Data

(63) Continuation of application No. 14/009,261, filed as application No. PCT/NL2012/050226 on Apr. 4, 2012, now abandoned.

(30) Foreign Application Priority Data

Apr. 5, 2011 (NL) ..... 2006543

(51) Int. Cl.
*B05B 7/00* (2006.01)
*B05B 11/04* (2006.01)

(52) U.S. Cl.
CPC ..... *B05B 11/04* (2013.01); *B05B 7/0037* (2013.01)

(58) Field of Classification Search
CPC ..... B05B 7/0018; B05B 7/0037; B05B 11/04
(Continued)

(56) References Cited

U.S. PATENT DOCUMENTS 6,394,315 B1 * 5/2002 Banks ..... B05B 7/0037 222/190
8,020,732 B2 * 9/2011 van der Heijden ... B05B 7/0025 222/190

(Continued)

FOREIGN PATENT DOCUMENTS

NL 1030994 * 10/2007
WO 2007/086730 A2 8/2007

(Continued)

OTHER PUBLICATIONS

Communication from the Chinese Patent Office for a counterpart foreign application, dated Jul. 3, 2015.

*Primary Examiner* — Charles Bushey
(74) *Attorney, Agent, or Firm* — Hoffmann & Baron, LLP

(57) ABSTRACT

A foam-forming assembly includes a housing having an air passage and a liquid passage, each ending in a mouth and being in communication with a dispensing passage having a dispensing opening, and a valve body which, in a rest position, covers the mouth of the liquid passage and the mouth of the air passage in a sealing manner in order to prevent a flow from the liquid passage and the air passage to the dispensing passage. During dispensing, the valve body opens the mouth of the liquid passage and the mouth of the air passage in order to allow mixing of air and liquid to take place in the dispensing passage. The mouth of the air passage is substantially annular, and the air passage includes a pressure balance chamber to divide the air pressure substantially equally over the substantially annular mouth.

17 Claims, 5 Drawing Sheets

(58) Field of Classification Search
USPC ..... 222/92, 190, 211; 261/76, DIG. 26
See application file for complete search history.

(56) References Cited

U.S. PATENT DOCUMENTS

| | | | | |
|---|---|---|---|---|
| 8,056,769 | B2 * | 11/2011 | van der Heijden | A47K 5/14 222/190 |
| 2002/0153389 | A1 * | 10/2002 | Creaghan | B05B 7/0037 222/190 |
| 2009/0001100 | A1 * | 1/2009 | van der Heijden | B05B 1/3026 222/190 |
| 2009/0200338 | A1 * | 8/2009 | Quinlan | A47K 5/16 222/190 |
| 2010/0001024 | A1 * | 1/2010 | van der Heijden | B05B 7/0025 222/190 |

FOREIGN PATENT DOCUMENTS

| | | | |
|---|---|---|---|
| WO | 2007/086731 | A1 | 8/2007 |
| WO | 2007/086732 | A1 | 8/2007 |
| WO | 2008/072949 | A2 | 6/2008 |
| WO | WO2008/072949 | A2 * | 6/2008 |
| WO | 2009/136781 | A1 | 11/2009 |

* cited by examiner

FOAM-FORMING ASSEMBLY AND SQUEEZE FOAMER

CROSS-REFERENCE TO RELATED APPLICATIONS

This application claims the priority benefit under 35 U.S.C. §120 as a continuation of non-provisional U.S. patent application Ser. No. 14/009,261 filed 1 Oct. 2013, now abandoned, having the same title and inventive entity as the instant application, which application in turn is a National Stage entry under 35 U.S.C. §371 of International Application No. PCT/NL2012/050226, filed Apr. 4, 2012, which claims the benefit of Netherlands Application No. 2006543, filed Apr. 5, 2011. The entire contents and disclosures of all aforementioned and/or priority applications are incorporated by reference herein for all purposes.

FIELD OF THE INVENTION

The present invention relates to a foam-forming assembly and a squeeze foamer comprising such foam-forming assembly. A squeeze foamer is a foam dispensing device having a container filled with a foamable liquid and air which is squeezed to produce a quantity of foam.

BACKGROUND OF THE INVENTION

Squeeze foamers and foam assemblies suitable for squeeze foamers are known. For example WO2007/086730, WO2007/086731, WO2007/086732, WO2008/072949 and WO2009/136781 disclose prior art squeeze foamers and foam-forming assemblies.

SUMMARY OF THE INVENTION

It is desirable that the foam dispensed by a foam-forming assembly and squeeze foamer has a good foam quality.

An object of the invention is to provide a foam-forming assembly which is configured to dispense foam of good and constant quality, or at least to provide an alternative squeeze foamer.

According to an aspect of the invention, the invention provides a foam-forming assembly, comprising:

a housing having an air passage and a liquid passage, each ending in a mouth and being in communication with a dispensing passage having a dispensing opening, and a valve body which, in a rest position, covers the mouth of the liquid passage and the mouth of the air passage in a sealing manner in order to prevent a flow from the liquid passage and the air passage to the dispensing passage, and which, during dispensing, opens the mouth of the liquid passage and the mouth of the air passage in order to allow mixing of air and liquid to take place in the dispensing passage, wherein the mouth of the air passage is substantially annular, and wherein the air passage comprises a pressure balance chamber to divide the air pressure substantially equally over the substantially annular mouth.

In some embodiments of known foam-forming assemblies for squeeze foamers, the pressure in the mouth of the air passage may not be the same at different locations in the mouth of the air passage. This may for instance be the case when the air inlet for mouth of the air passage is not arranged concentrically with the substantially annular mouth. In the present invention it is realized that the distribution of pressure over the circumference of the mouth of the air passage, and therewith the foam quality may substantially be improved by the provision of as pressure balance chamber configured to equally distribute the air pressure over the mouth of the air passage.

The pressure balance chamber is a part of the air passage configured to distribute air over the circumference of the mouth of the air passage to obtain a substantially constant air pressure over the circumference of the mouth of the air passage.

The pressure balance chamber may comprise a relative large volume of the total volume of the air passage. The volume of the pressure balance chamber is, for example, at least 25%, preferably at least 40% of the total volume of the air passage. The pressure balance chamber may further be substantially circular-symmetrical and/or concentrically with the mouth of the air passage.

The air passage comprises an air inlet and a substantially annular mouth. The pressure balance chamber is provided between the air inlet and the substantially annular mouth. Preferably, a cross section of the air inlet and a cross section of the air passage between the pressure balance chamber and the mouth of the air passage are both substantially smaller than the cross section of the pressure balance chamber.

The air inlet of the air passage is provided to introduce air from an air source, in particular a container, into the foam-forming assembly to form a foam, for example when a container of a squeeze foamer is being squeezed. In an embodiment, the air inlet is arranged non-concentrically with the substantially annular mouth of the air passage.

In an embodiment, the cross section of the air inlet is larger than the cross section of the air passage between the pressure balance chamber and the mouth of the air passage.

The pressure balance chamber and the substantially annular mouth of the air passage are preferably arranged adjacent to each other, and in fluid communication with each other.

Preferably, a cross section between the pressure balance chamber and the mouth of the air passage is the smallest cross section of the air passage, i.e. smaller than the cross sections of the air inlet, the pressure balance chamber, and the mouth of the air passage. By providing the smallest cross section of the air passage between the pressure balance chamber and the mouth of the air passage, the pressure build-up within the pressure balance chamber can be positively influenced. Therewith, the pressure can be more equally divided over the circumference of the mouth of the air passage The cross section between the mouth of the air passage and the pressure balance chamber may for instance be at least 5 times smaller, or at least 10 times smaller than the cross section of the pressure balance chamber.

In an embodiment, the mouth of the air passage and the pressure balance chamber are in communication with each other via multiple holes in a wall between the substantially annular mouth and the pressure balance chamber, wherein the multiple holes are substantially equally divided over the circumference of the mouth of the air passage. By provision of a wall with multiple holes substantially equally divided over the circumference of the mouth of the air passage, between the pressure balance chamber and the mouth of the air passage, the equal air pressure within the pressure balance chamber can be properly distributed over the circumference of the mouth of the air passage.

Preferably, at least three holes are provided in the wall between the pressure balance chamber and the mouth of the air passage.

In an embodiment, the cross section of the multiple holes in the wall between the pressure balance chamber and the mouth of the air passage is substantially smaller than the cross section of the pressure balance chamber. The cross section of the pressure balance chamber is preferably at least 10 times, preferably at least 25 times the cross section of the holes in the wall between the pressure balance chamber and the mouth of the air passage.

Preferably, the multiple holes together have a smallest cross section of the air passage.

In an embodiment, the mouth of the air passage is an annular opening. However, in an alternative embodiment, the mouth of the air passage may comprise multiple air passage openings arranged in a circle.

In an embodiment, a cross section of the air passage between the pressure balance chamber and the mouth of the air passage is substantially smaller than a cross section of the pressure balance chamber. The cross section of the air passage or a part thereof is determined in a plane perpendicular to the longitudinal axis of the foam-forming assembly.

In an embodiment, the air passage comprises an air inlet to connect an air inlet tube, wherein the air inlet is arranged non-concentrically with the substantially annular mouth of the air passage. In the absence of a pressure balance chamber, such non-concentrically arranged air inlet tube may cause an unequal distribution of air pressure within the mouth of the air passage. By providing a pressure balance chamber between the air inlet and the substantially annular mouth of the air passage, the air pressure may more equally be provided over the circumference of the substantially annular mouth of the air passage.

The cross section of the air inlet may be substantially smaller than the cross section of the pressure balance chamber. For example, the cross section of the air inlet may be at least 5 times smaller, or at least 10 times smaller than the cross section of the pressure balance chamber.

The cross section of the air inlet is preferably larger than the cross section of the fluid connection between the pressure balance chamber and the substantially annular mouth of the air passage, for example the cross section of multiple holes in a wall between the pressure balance chamber and the substantially annular mouth.

The foam-forming assembly may comprise an air inlet tube connected to the air inlet. The air inlet tube is arranged to connect the air inlet which is arranged at a relatively low level, and will typically be below a liquid level in the container to an upper region of the interior of the container. This upper region will contain air when the container is held in the position in which the foam-forming assembly is intended to be used. The air inlet tube may be a separate part or form an integral part with the air inlet.

Also the cross section between the pressure balance chamber and the mouth of the air passage may be smaller than the cross section of the air inlet tube.

It is desirable that the foam quality of foam dispensed by a squeeze foamer is sufficient directly at the beginning of squeezing the container. Also slightly pressing on the container should not result in dispensing of only liquid or foam of very poor quality.

In an embodiment, the mouth of the air passage is annular and arranged on a first circle, and the mouth of the liquid passage and inlet openings of the dispensing passage are arranged on a second circle, wherein the first circle and the second circle are arranged concentrically and adjacent to each other. Preferably, the diameter of the first circle is larger than the diameter of the second circle.

According to another aspect of the invention, the invention provides a foam-forming assembly, comprising:

a housing having an air passage and a liquid passage, each ending in a mouth and being in communication with a dispensing passage having a dispensing opening, and a valve body which, in a rest position, covers the mouth of the liquid passage and the mouth of the air passage in a sealing manner in order to prevent a flow from the liquid passage and the air passage to the dispensing passage, and which, during dispensing, opens the mouth of the liquid passage and the mouth of the air passage in order to allow mixing of air and liquid to take place in the dispensing passage, wherein the mouth of the air passage is annular and arranged on a first circle, and the mouth of the liquid passage and inlet openings of the dispensing passage are arranged on a second circle, wherein the first circle and the second circle are arranged concentrically and adjacent to each other.

Preferably, the diameter of the first circle is larger than the diameter of the second circle.

In such arrangement, depressing of the container will result in fluid communication between the mouth of the air passage and the inlet openings just before fluid communication between the mouth of the liquid passage and the inlet openings. Thus, depressing of the container will first result in dispensing of air, and the foam dispensed by the foam-forming assembly will directly result in foam of good quality. Also slightly pressing the container will result in only dispensing of air, and not dispensing of liquid, the latter being undesirable.

During actuation of the squeeze framer, the container of the squeeze framer is pressed in to dispense air and liquid from the container. After dispensing a quantity of foam, the container should return to its original state due to flexibility of the container itself and/or biasing means. An air inlet channel is provided to introduce air into the container to replace the air and liquid dispensed during the dispensing of the foam.

It is desirable that the air that is introduced through the air inlet channel will not go through the liquid in the container, so that no foam is formed in the container before actual dispensing of liquid to form a foam from the container. Therefore, the air inlet channel is connected to the air passage so that the air can enter the container through the air passage to an upper region of the interior of the container.

However, it is undesirable that a small amount of foam present in the mouth of the air passage enters the air inlet channel, as the presence of foam in the air inlet channel may substantially slow down the speed with which air may enter the container via the air inlet channel.

In an embodiment, the foam-forming assembly comprises an air inlet channel to introduce air into the container, wherein the air inlet channel is connected to the air passage between the mouth of the air passage and an air inlet to connect an air inlet tube, wherein the location of connection of the air inlet channel and the air passage is spaced from the mouth of the air passage.

According to another aspect of the invention, the invention provides a foam-forming assembly, comprising:

a housing having an air passage and a liquid passage, each ending in a mouth and being in communication with a dispensing passage having a dispensing opening, and a valve body which, in a rest position, covers the mouth of the liquid passage and the mouth of the air passage in a sealing manner in order to prevent a flow from the liquid passage and the air passage to the dispensing passage, and which, during dispensing, opens the mouth of the liquid passage and the mouth of the air passage in order to allow mixing of air and liquid to take place in the dispensing passage, wherein the foam-forming assembly comprises an air inlet channel to introduce air into the container, wherein the air inlet channel is connected to the air passage between the mouth of the air passage and an air inlet to connect an air inlet tube, wherein the location of connection of the air inlet channel and the air passage is spaced from the mouth of the air passage.

By spacing, preferably in the vertical direction, the connection between the air inlet channel and the air passage from the mouth of the air passage, the chance that foam will enter the air inlet channel will substantially decrease.

In an embodiment, the air inlet channel is connected to the air passage at the location of the pressure balance chamber.

In an embodiment, the housing comprises a first housing part and a second housing part mounted on the first housing part, wherein the second housing part defines the mouth of the liquid passage and the mouth of the air passage, and wherein between the first housing part and the second housing part the air pressure balance chamber is formed.

With such housing comprising such first and second housing part, the pressure balance chamber can be efficiently formed between the first and second housing part. In the second housing part, openings can be provided which connect the mouth of the air passage with the pressure balance chamber. As described above these openings are preferably divided over the circumference of the mouth of the air passage The first housing part may comprise a tube-shaped part configured to connect an air inlet tube to the housing. The first housing part may further comprise a sealing rim to cooperate with a sealing rim of the second housing part to form a central liquid passage substantially on the longitudinal axis the centre of the foam-forming assembly. The pressure balance chamber formed between the first and the second housing part may surround the central liquid passage, and may connect the air inlet channel to the air passage.

In an embodiment, the mouth of the liquid passage comprises multiple outlet openings arranged in a circle, wherein the multiple outlet openings, in the rest position, are covered by the valve body, wherein the valve body comprises at least at the location of the multiple outlet openings a substantially tube-shaped part, and wherein, in the at rest position, an inner surface of the tube-shaped part covers the multiple outlet openings.

According to another aspect of the invention, the invention provides a foam-forming assembly, comprising:

a housing having an air passage and a liquid passage, each ending in a mouth and being in communication with a dispensing passage having a dispensing opening, and a valve body which, in a rest position, covers the mouth of the liquid passage and the mouth of the air passage in a sealing manner in order to prevent a flow from the liquid passage and the air passage to the dispensing passage, and which, during dispensing, opens the mouth of the liquid passage and the mouth of the air passage in order to allow mixing of air and liquid to take place in the dispensing passage, wherein the mouth of the liquid passage comprises multiple outlet openings arranged in a circle, wherein the multiple outlet openings, in the rest position, are covered by the valve body, wherein the valve body comprises at least at the location of the multiple outlet openings as substantially tube-shaped part, and wherein, in the at rest position, an inner surface of the tube-shaped part covers the multiple outlet openings.

The tube shaped part of the valve body provides a very suitable form to close the outlet openings of the mouth of the liquid passage.

In an embodiment, the housing defines multiple inlet openings for the dispensing passage, and wherein the multiple inlet openings are arranged on the same circle as the outlet openings of the mouth of the liquid passage.

The invention further relates to a squeeze foamer comprising a compressible container having an opening, and the foam-forming assembly of any of the claims 1-14 mounted on or in the opening.

In alternative embodiments of dispensing devices for dispensing a foam, a foam-forming assembly according to the invention may be arranged in or on a container holding a liquid and gas under pressure, for instance on a container with a foamable liquid and a propellant. Also, the foam-forming assembly may be combined with any other device which can provide a foamable liquid and gas under pressure, for instance a device having a liquid pump and an air pump or a device having a liquid supply and air supply which are continuously under pressure.

BRIEF DESCRIPTION OF THE DRAWINGS

The invention will be explained in more detail below by means of an exemplary embodiment in which reference will be made to the attached drawings, in which.

DETAILED DESCRIPTION OF THE INVENTION

Figure 1:
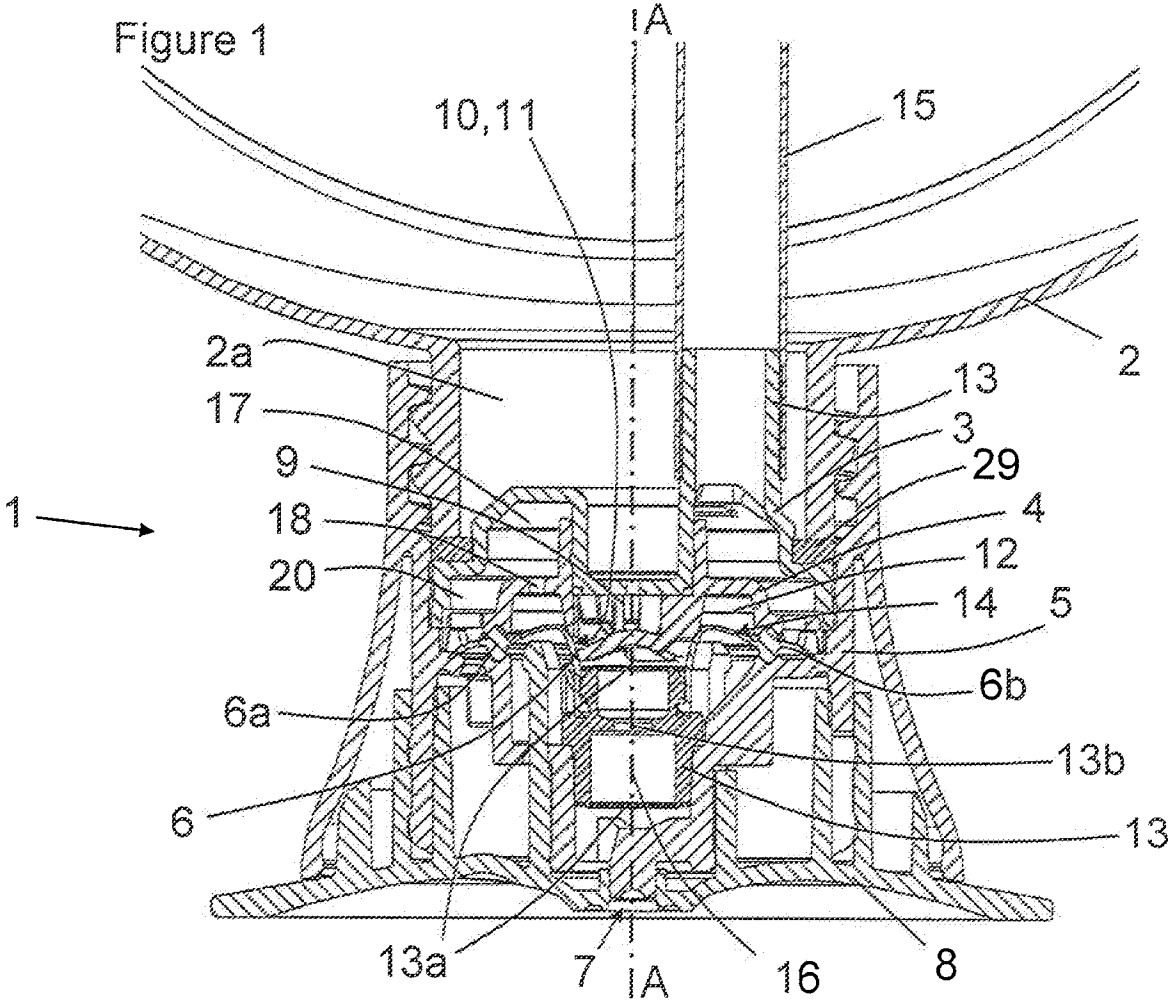
FIG. 1 shows a cross section of an embodiment of a squeeze foamer according to the invention.

FIG. 1 shows an embodiment of a dispensing device according to the invention. The dispensing device is denoted overall by reference numeral 1. The dispensing device 1 is of the squeeze foamier type. Such a squeeze foamer dispenses a foam through a dispensing opening as a result of a container being squeezed. After it has been squeezed, the container will return to the original state, either by the elasticity of the container itself or by restoring means which are provided in order to return the container to its original state.

The foam which can be formed using the dispensing device 1 may be suitable for various different uses, such as, for example, as soap, shampoo, shaving foam, washing-up liquid, sun-tan lotion, after-sun lotion, washing liquid, skin-care products and the like.

The dispensing device is shown in the rest position, that is to say that the container is not being squeezed.

The illustrated squeeze foamer can be held in a hand during delivery. It is also possible to install it or a similar dispensing device into a holder which is to be attached, for example, to the wall, similar to holders which can, for example, be found in public toilets for dispensing of liquid soaps. Any other device for squeezing the container may also be used. The dispensing device is designed to be used in the position as shown in FIG. 1, i.e. with the dispensing opening pointing substantially downwards.

The dispensing device 1 comprises a manually compressible container 2 containing a liquid and air. The container has an opening 2*a* on which a foam-forming assembly is fitted. The container 2 may have any suitable shape, for example a shape having an elliptical or a circular cross section.

The foam-forming assembly is substantially circular-symmetrical with respect to a longitudinal axis of symmetry A-A. The foam-forming assembly comprises a housing with a first housing part 3, a second housing part 4 and a third housing part 5. The third housing part 5 is attached to the container 2 by means of a threaded connection. The first housing part 3 and the second housing part 4 are clamped in a sealing manner between the container 2 and the third housing part 5. Alternatively, the third housing part 5 may be attached by means of a snap connection, a welded connection, an airtight seal or another suitable connection on or in the container 2.

In FIGS. 4, 5, 6 and 7 the first housing part 3 and second housing part 4 are shown in top view and bottom view.

The foam-forming assembly comprises a substantially conical valve body 6 which is clamped near clamping section 6*a* between the second housing part 4 and the third housing part 5. The valve body 6 is made from a flexible, preferably elastic material. Silicone, such as for example Liquid Silicone Rubber (LSR), has proved to be a particularly suitable material for the valve body 6.

In the shown position of the dispensing device, the air is, relative to the liquid, situated at the top of the container 2, i.e. in an upper region of the container 2. The liquid and air can be turned into a foam by means of the foam-forming-assembly, which is dispensed through a dispensing opening 7 in the cap 8. The cap is shown in closed position. For dispensing of foam the cap may be displaced in downwards direction with respect to the foam-forming assembly to open the dispensing opening 7. Any other suitable means to open and close the dispensing opening, for example a flip top may also be applied.

The foam-forming assembly comprises a liquid passage 9 and an air passage 12. The liquid passage runs from the lower interior of the container to an annular mouth 10 of the liquid passage formed by three outlet openings 11 defined by the second housing part 4. The first housing part 3 comprises a cylindrical central part to be sealingly placed in a cylindrical part of the second housing part 4 to form a central liquid passage substantially on the longitudinal axis of the foam-forming assembly. The first housing part 3 comprises an opening 9*a* which is part of the liquid passage 9.

The air passage 12 runs from an air inlet 13 to an annular mouth 14 of the air passage. The annular mouth 14 of the air passage 12 is formed by a single annular opening. As an alternative the annular mouth may be formed by one or more openings arranged in a circle. The air inlet 13 is a tube-shaped part on the first housing part 3 on which an air inlet tube 15 is arranged to connect an upper region of the interior of the container with the air inlet 13.

The mouth 14 of the air passage 12 is arranged on a first circle. The mouth 10 of the liquid passage 9 and entry ports 30 of the dispensing passage 16 are arranged on a second circle. The first circle and the second circle are arranged concentrically and adjacent to each other.

The annular mouth 10 of the liquid passage and annular mouth 14 of the air passage are arranged concentrically with respect to the longitudinal axis A-A. Due to the annular mouths 10, 14, the liquid and air are distributed over a circular and relatively large surface area, resulting in a relatively good mixing.

In the rest position shown in FIG. 1, the annular mouths 10, 14 of the liquid passage and air passage are sealed by the valve body 6. An annular arcuate section of the valve body 6 extends into the mouth 14 of the air passage 12. At the location of the multiple outlet openings 11 of the annular mouth 9 of the liquid passage 10 the valve body 6 comprises a substantially tube-shaped part. An inner surface of this tube-shaped part of the valve body sealingly covers the outlet openings 11 in the at rest position of the dispensing device 1, The arcuate section and the tube shaped part provide a proper sealing of the mouths 10, 14.

Figure 2:
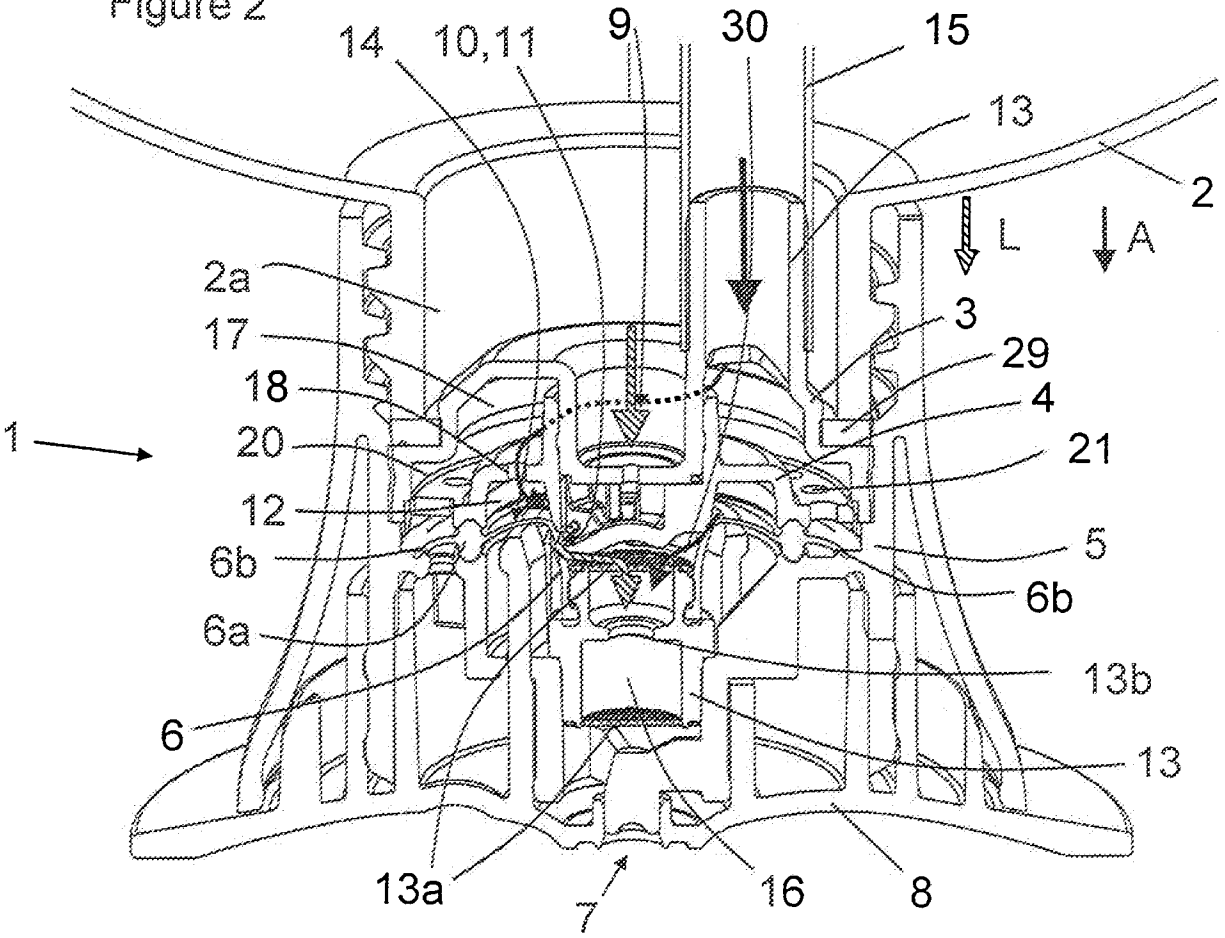
FIG. 2 shows an isometric cross section of the embodiment of FIG. 1 during dispensing of foam.

During dispensing, i.e. when the container 2 of the dispensing device 2 is depressed, the valve body 6 opens the mouth 10 of the liquid passage and the mouth 14 of the air passage with respect to three entry ports 30, i.e. inlet openings, of a dispensing passage 16, The dispensing passage 16 ends in the dispensing opening 7. Upon depression of the container, liquid flows from the mouth 10 of the liquid passage 9 and air flows from the mouth 14 of the air passage 12 into the entry ports 30 of the dispensing passage in order to allow mixing of air and liquid to form a foam in the dispensing passage, and to dispense the formed foam via the dispensing opening 7. The flows of liquid and air through the liquid and air passage to form a foam are schematically shown in FIG. 2.

The dispensing passage 16 runs from the entry ports 30 through the central part of the valve body 6 to the dispensing opening 7. In the dispensing passage 16 a sieve element 13 is arranged with two sieves 13*a* and a constriction 13*b* between the two sieves 13*a*.

Generally, the air passage 12 comprises one or more air ducts which bring the air in the container in fluid communication with the mouth 14 of the air passage 12 which, in the rest position, is covered by the valve body 6. The liquid passage correspondingly contains one or more liquid ducts which bring the liquid in the container in fluid communication with the mouth 10 of the liquid passage 9 which, in the rest position, is covered by the valve body 6.

The valve body 6 is sealingly clamped between the second housing part 4 and the third housing part 5. In order, in the rest position, to achieve a better sealing of the valve body 6 on the mouths 10, 14 of the liquid passage 9 and air passage 12, the valve body 6 is fitted with some axial pretension between the second housing part 4 and the third housing part 5.

The air inlet tube 15 is arranged non-concentrically with the annular mouth 14 of the air passage 12. To avoid an uneven distribution of air pressure over the annular mouth 14 of the air passage 12, the air passage comprises a pressure balance chamber 17 in the air passage 12 between the air inlet 13 and the mouth 14 of the air passage 12.

The pressure balance chamber 17 is configured to distribute the air pressure which comes into existence during actuation of the squeeze foamer evenly over the circumference of the annular mouth 14.

The pressure balance chamber 17 is formed by a space between the first housing part 3 and the second housing part 4. The mouth 14 of the air passage 12 and the pressure balance chamber 17 are in communication with each other via three holes 18 in the second housing part 5. The multiple holes 18 are substantially equally divided over the circumference of the mouth 14 of the air passage 12. The angular position of the air inlet 13 is located between two of the holes 18. Preferably, the air inlet 13 is not arranged in line with one of the holes 18.

To positively influence the equal distribution of the air pressure over the circumference of the mouth 14 of the air passage 12, the holes 18 have together a cross section which is the smallest cross section of the complete air passage 12, including the air inlet tube 15.

To obtain an even distribution of air pressure over the mouth 14 of the air passage 12, the holes 18 have together a substantially smaller cross section than the cross section of the pressure balance chamber 17. The cross section of the holes 18 may for example be at least 10, preferably at least 25 times smaller than the cross section of the pressure balance chamber, measured in a plane substantially parallel to the plane wherein the holes 18 are arranged. Further, or as an alternative, the volume of the pressure balance chamber 17 may be relatively large, for example at least 25%, preferably at least 40% of a total volume of the air passage 12.

The relative large volume of the pressure balance chamber 17 and/or the relative small cross section of the holes 18, the pressure over the circumference of the pressure balance chamber is substantially equal. As a result, the flow of air to the annular mouth 14 will be equally through the holes 18 resulting in an equal pressure over the annular mouth 14.

It is remarked that the cross section of the air inlet 13 is also substantially smaller than the cross section of the pressure balance chamber 17.

Figure 3:
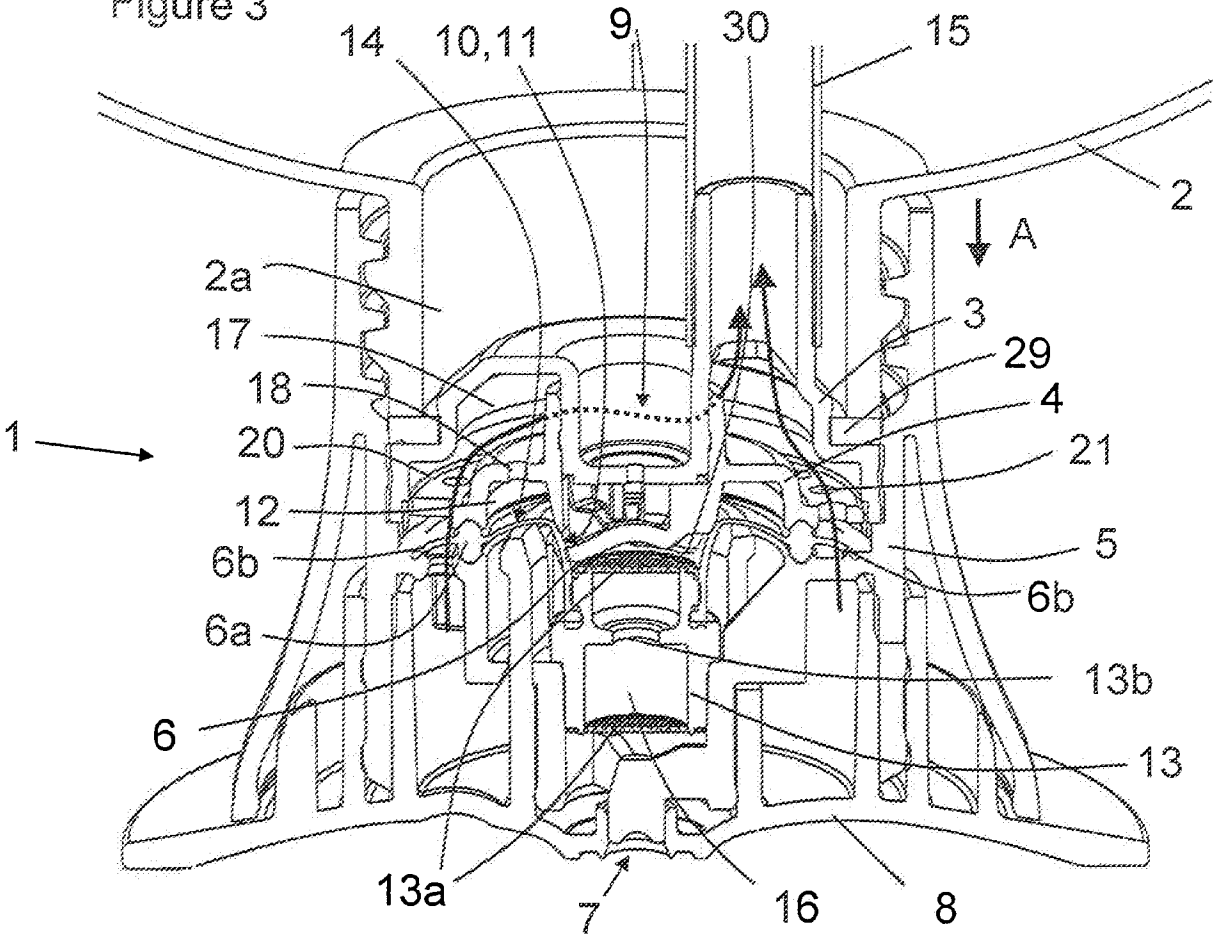
FIG. 3 shows an isometric cross section of the embodiment of FIG. 1 during aeration of the container.
Figure 4:
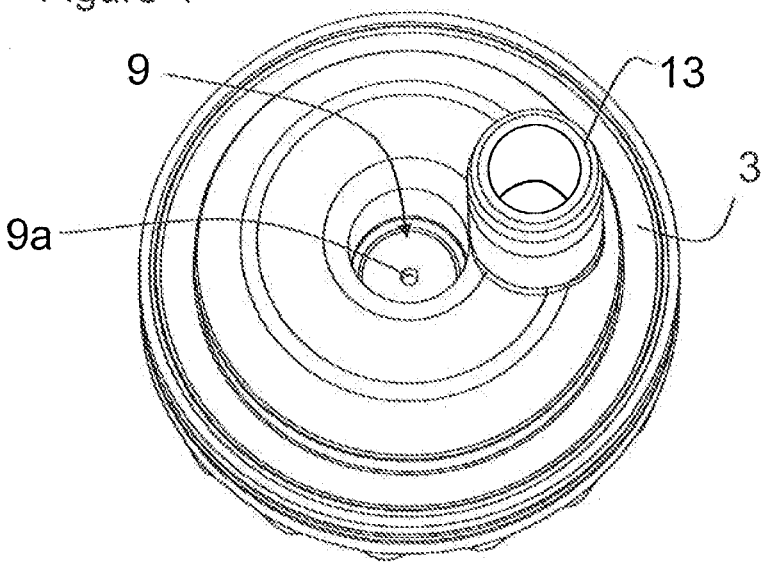
FIGS. 4 and 5 show an isometric top and bottom view on the first housing part of the housing of the embodiment of FIG. 1.
Figure 5:
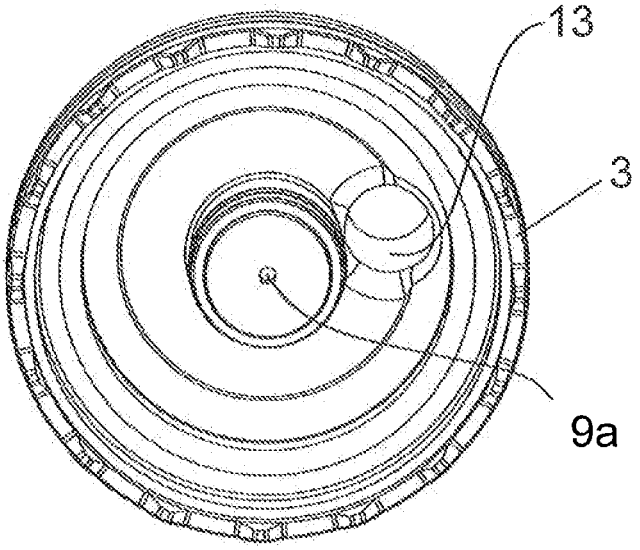
Figure 6:
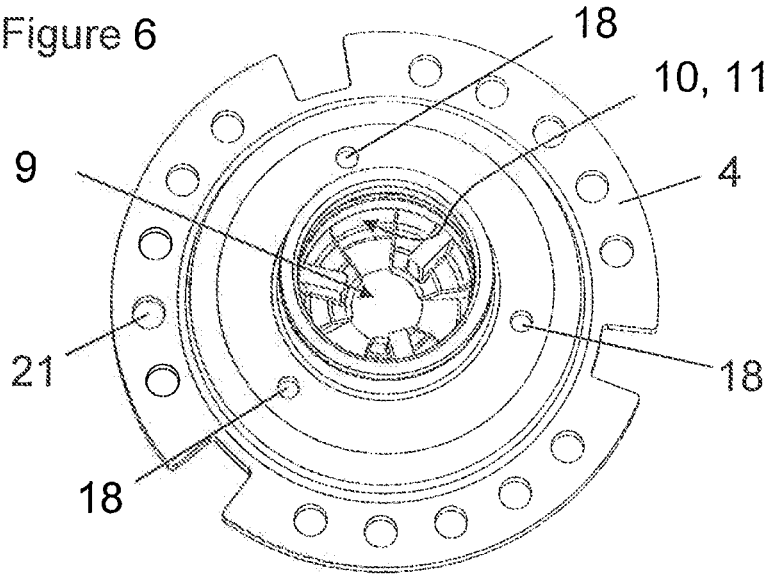
FIGS. 6 and 7 show an isometric top and bottom view on the second housing part of the housing of the embodiment of FIG. 1.
Figure 7:
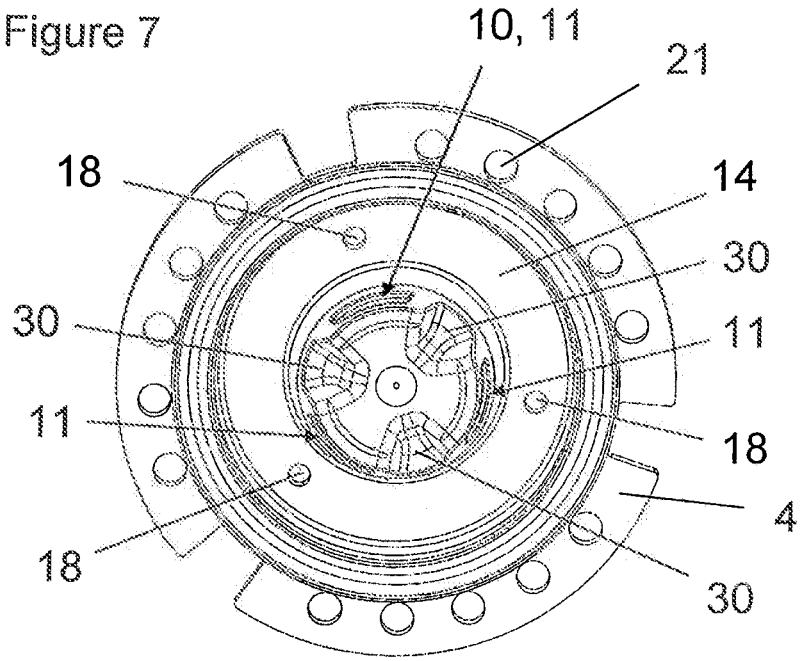

The foam-forming assembly comprises an air inlet channel 20 to introduce air into the container 2. During actuation of the squeeze foamer, the container of the squeeze foamer is pressed in to dispense air and liquid from the container. After dispensing a quantity of foam, the container should return to its original state due to flexibility of the container itself and/or restoring means. The air inlet channel 2 is provided to introduce air into the container 2 to replace the air and liquid dispensed during the dispensing of the foam. The flow of air during this introduction of air into the container is schematically shown in FIG. 3.

On the side arranged on the outside of the clamping section 6*a*, the valve body 6 has an annular sealing lip 6*b* which serves as a valve for an air inlet valve which allows air into the container 2 via the air inlet channel 20 when a certain reduced pressure is created in the container 2 as a result of the liquid and air in the container 2 being dispensed. The sealing lip 6*b* normally seals the passage of the container 2 towards the outside, but will allow a flow of air from outside into the container 2 through air inlet openings 21 and the air inlet channel 20, when there is a reduced pressure in the container 2.

It is desirable that the air that is introduced through the air inlet channel 20 will not go through the liquid in the container 2, so that no foam is formed in the container before actual dispensing of the foam from the foam-forming assembly. Therefore, the air inlet channel 20 is connected to the air passage 12 so that the air can enter the container 2 through the air passage 12 and the air inlet tube 15 to an upper region of the interior of the container 2.

The presence of foam in the air inlet channel 20 may substantially slow down the speed with which air may enter the container 2 via the air inlet channel 20, and thus the time required to restore the original state of the container 2. To avoid that small amounts of foam present in the mouth of the air passage enter the air inlet channel 20, the air inlet channel 20 is connected to the air passage 12 at the location of the pressure balance chamber 17. The wall of the second housing part 4 provides a proper separation between the mouth 14 of the air passage 12 and the air inlet channel 20. The holes 18 have a relative small cross section and are spaced from the mouth 14 in vertical direction so that the chance that foam from the mouth 14 will enter the air inlet channel 20 is very small.

To avoid any deformation of the valve body 6 due to rotation of the second housing part 4 with respect to the third housing part 5 a rotational stop is arranged between the first housing part 3 and the third housing part 5, and between the first housing part 3 and the second housing part 4. Such deformation could come into existence due to the rotational movement of the container with respect to the foam-forming assembly when mounting the foam-forming assembly on the container in case the rotational stop would be absent. Such deformation is undesirable since the deformation may lead to different opening pressures of the valve body 6 and/or leakage of the valve body 6.

A gasket 29 is provided between the first housing part 3 and the container to provide a seal between the first housing part 3 and the container 2. A gasket 29 has the advantage that a proper sealing is obtained between the foam-forming assembly and the container 2. Irregularities in the sealing surface of the container 2 or the first housing part 3, for instance caused by manufacturing, may be taken into account by the material of the gasket 29 which preferably is elastic.

When the container 2 is squeezed, the pressure in the container 2 will increase. Initially, the increasing pressure will ensure that the arcuate section of the valve body 6 is pressed more strongly against the inner annular edge of the mouth 14 of the air passage 12, resulting in an improved sealing between the valve body 6 and the inner annular edge, When the pressure in the container 2 is increased further by squeezing the latter, the arcuate section will at some point move down, as a result of which it will detach from the inner annular edge of the mouth 14 of the air passage 12.

At the moment the valve body 6 becomes detached from the annular sealing edge, both the mouth 10 of the liquid passage 9 and the mouth 14 of the air passage 12 will substantially simultaneously come in communication with each other and the entry ports 30 of the dispensing passage. As a consequence, a mixture of air and liquid will come into existence, which as a result of the pressure which is caused by compressing the container, will flow into the dispensing passage via the entry ports 30.

This mixture of air and liquid will then flow through the small sieves 13*a* and the constriction 13*b*, which will produce an (improved) foam. This foam will flow down through the dispensing passage towards the dispensing opening 7, where it will be dispensed.

Thus, upon actuation of the foam-forming assembly, the valve body 6 as it were successively rolls over the inner annular edge of the mouth 14, (i.e. the sealing ring between the first circle with the annular mouth 14 and the second circle with the outlet openings 11 and the entry ports 30), so that the mouths 10, 14, and the entry ports 30 come into fluid communication with each other.

It is remarked that the valve body 6 and the mouths 10 and 14 are configured such that, upon depressing of the container 2, the mouth 14 of the air passage 12 will open just before the mouth 10 of the liquid passage 9, i.e. the mouth 14 will come into fluid communication with the entry ports 30 just before the mouth 10 will come into fluid communication with the entry ports 30. As a result, the foam dispensed from the dispensing device will directly be of good quality. In contrast, when the mouth 10 would open just before the mouth 14, the foam dispensed from the dispensing device may initially be very wet, and when the container is only slightly depressed only liquid may flow from the dispensing opening.

With the construction as presently presented the foam may have the desired quality.

The above-described embodiment of a squeeze foamer has been described in a position where the dispensing opening points downwards. All references to above and/or below are made relative to this position. The dispensing device is designed to be used in this position. However, it is possible to provide an embodiment in which the dispensing device can be turned upside down (inverted with respect to the position shown) in order to dispense foam and/or rest. Such embodiments are deemed to fall within the scope of protection of this invention.

For further details of the construction of the embodiments of the squeeze foamer, reference is made to WO2007/086730, WO2007/086731, WO2007/086732, WO2008/072949 and WO2009/136781, the contents of which are hereby incorporated.

It will be clear to the person skilled in the art that all individual features which have been mentioned with respect to one of the aspects can also be applied in an embodiment according to one of the other aspects of the invention. Such embodiments are thus deemed to fail within the scope of protection of the invention.

The invention claimed is:

1. A foam-forming assembly, comprising:

a housing having an air passage and a liquid passage, each ending in a mouth and being in communication with a dispensing passage having a dispensing opening, and a valve body having a rest position, in which the valve body covers the mouth of the liquid passage and the mouth of the air passage in a sealing manner, in order to prevent a flow from the liquid passage and the air passage to the dispensing passage, the valve body further having a dispensing position, in which the valve body opens the mouth of the liquid passage and the mouth of the air passage in order to allow mixing of air and liquid to take place in the dispensing passage, wherein the mouth of the air passage is substantially annular, and wherein the air passage comprises a pressure balance chamber to divide the air pressure substantially equally over the substantially annular mouth, and wherein the mouth of the air passage and the pressure balance chamber are in communication with each other via multiple holes in a wall between the substantially annular mouth and the pressure balance chamber, wherein the multiple holes are substantially equally divided over the circumference of the mouth of the air passage.

2. The foam-forming assembly of claim 1, wherein a smallest cross section of the air passage is provided between the pressure balance chamber and the mouth of the air passage.

3. The foam-forming assembly of claim 1, wherein the pressure balance chamber is arranged between an air inlet of the air passage and the substantially annular mouth of the air passage, and wherein a cross section of the air inlet and a cross section of the air passage between the pressure balance chamber and the mouth of the air passage are substantially smaller than the cross section of the pressure balance chamber.

4. The foam-forming assembly of claim 3, wherein the cross section of the air inlet is larger than the cross section of the air passage between the pressure balance chamber and the mouth of the air passage.

5. The foam-forming assembly of claim 1, wherein the multiple holes together have a smaller cross section than the cross section of the pressure balance chamber, wherein the multiple holes together have a smallest cross section of the air passage.

6. The foam-forming assembly of claim 1, wherein the multiple holes are at least three holes.

7. The foam-forming assembly of claim 1, wherein the air passage comprises an air inlet to connect an air inlet tube, wherein the air inlet is arranged non-concentrically with the substantially annular mouth of the air passage.

8. The foam-forming assembly of claim 1, wherein a volume of the pressure balance chamber is at least 20% of a total volume of the air passage.

9. The foam-forming assembly of claim 8, wherein a volume of the pressure balance chamber is at least 40% of a total volume of the air passage.

10. The foam-forming assembly of claim 1, wherein a cross section of the air passage between the pressure balance chamber and the mouth of the air passage is substantially smaller than a cross section of the pressure balance chamber.

11. The foam-forming assembly of claim 1, wherein the foam-forming assembly comprises an air inlet channel to introduce air into the container, wherein the air inlet channel is connected to the air passage between the mouth of the air passage and an air inlet to connect an air inlet tube, wherein the location of connection of the air inlet channel and the air passage is spaced from the mouth of the air passage.

12. The foam-forming assembly of claim 11, wherein the air inlet channel is connected to the air passage at the location of the pressure balance chamber.

13. The foam-forming assembly of claim 1, wherein the housing comprises a first housing part and a second housing part mounted on the first housing part, wherein the second housing part defines the mouth of the liquid passage and the mouth of the air passage, and wherein between the first housing part and the second housing part the air pressure balance chamber is formed.

14. A squeeze foamer comprising a compressible container having an opening, and the foam-forming assembly of claim 1 mounted on or in the opening.

15. A foam-forming assembly, comprising:

a housing having an air passage and a liquid passage, each ending in a mouth and being in communication with a dispensing passage having a dispensing opening, and a valve body having a rest position, in which the valve body covers the mouth of the liquid passage and the mouth of the air passage in a sealing manner, in order to prevent a flow from the liquid passage and the air passage to the dispensing passage, the valve body further having a dispensing position, in which the valve body opens the mouth of the liquid passage and the mouth of the air passage in order to allow mixing of air and liquid to take place in the dispensing passage, wherein the mouth of the air passage is substantially annular, and wherein the air passage comprises a pressure balance chamber to divide the air pressure substantially equally over the substantially annular mouth, and wherein the mouth of the air passage is annular and arranged on a first circle, and wherein the mouth of the liquid passage and inlet openings of the dispensing passage are arranged on a second circle, wherein the first circle and the second circle are arranged concentrically and adjacent to each other.

16. A foam-forming assembly, comprising:

a housing having an air passage and a liquid passage, each ending in a mouth and being in communication with a dispensing passage having a dispensing opening, and a valve body having a rest position, in which the valve body covers the mouth of the liquid passage and the mouth of the air passage in a sealing manner, in order to prevent a flow from the liquid passage and the air passage to the dispensing passage, the valve body further having a dispensing position, in which the valve body opens the mouth of the liquid passage and the mouth of the air passage in order to allow mixing of air and liquid to take place in the dispensing passage, wherein the mouth of the air passage is substantially annular, and wherein the air passage comprises a pressure balance chamber to divide the air pressure substantially equally over the substantially annular mouth, and wherein the mouth of the liquid passage comprises multiple outlet openings arranged in a circle, wherein the multiple outlet openings are covered by the valve body in the rest position, wherein the valve body comprises at least at the location of the multiple outlet openings a substantially tube-shaped part, and wherein, in the at rest position, an inner surface of the tube shaped part covers the multiple outlet openings.

17. The foam-forming assembly of the claim 16, wherein the housing defines multiple inlet openings for the dispensing passage, and wherein the multiple inlet openings are arranged on the same circle as the outlet openings of the mouth of the liquid passage.

* * * * *